US005497575A

United States Patent [19]

Fried

[11] Patent Number: 5,497,575

[45] Date of Patent: Mar. 12, 1996

[54] RIFLE SUPPORT APPARATUS

[75] Inventor: Joseph Fried, Kiryat Ono, Israel

[73] Assignee: Yamit Sachar Ltd., Tel Aviv, Israel

[21] Appl. No.: 364,213

[22] Filed: Dec. 27, 1994

[30] Foreign Application Priority Data

Dec. 27, 1993 [IL] Israel ..... 108201

[51] Int. Cl.[6] ..... F41A 23/00

[52] U.S. Cl. ..... 42/94; 89/37.04

[58] Field of Search ..... 42/94; 89/37.04

[56] References Cited

U.S. PATENT DOCUMENTS

| | | | |
|---|---|---|---|
| 1,076,692 | 10/1913 | Nikodem | 42/94 |
| 2,290,545 | 7/1942 | Doering | 42/94 |
| 2,774,563 | 12/1956 | Pribis | 42/94 |
| 4,548,392 | 10/1985 | Rickling | 42/94 |
| 4,565,403 | 1/1986 | Brown | 42/94 |
| 4,702,029 | 10/1987 | DeVaul et al. | 42/94 |
| 5,058,302 | 10/1991 | Minneman | 42/94 |

*Primary Examiner*—Charles T. Jordan
*Assistant Examiner*—Theresa M. Wesson
*Attorney, Agent, or Firm*—Darby & Darby

[57] ABSTRACT

Support apparatus for a rifle having a barrel, a bipod and a butt, the apparatus including a ground mat having first and second recesses wherein the first recess is adapted to secure the rifle bipod and the second recess containing a telescoping member is adapted to support the butt of the rifle.

22 Claims, 8 Drawing Sheets

RIFLE SUPPORT APPARATUS

FIELD OF THE INVENTION

The present invention relates generally to rifle support apparatus, and in particular to a combination portable ground mat and rifle support apparatus.

BACKGROUND OF THE INVENTION

Accuracy in the firing of a rifle depends to a large extent on how securely and steadily the rifle is supported at the moment of firing. For this purpose, it is known to use a bipod which is placed on the ground and which is adapted to support the barrel of the rifle. Many rifles are issued with such bipods as standard equipment, for ready mounting as needed. However, accuracy of firing also requires securing and support of the rifle at the butt end. For quick firing, this is normally accomplished by supporting the butt with the shoulder and arm of the marksman. However, for hunters or sharpshooters in the field, it is not possible to sustain such a shoulder and arm support position for lengthy periods of time. In such event, additional ad hoc props are normally utilized, such as a large rock or a sand-filled sack. However, these props are often not readily available and even when available may not provide the proper type of support needed for accurate firing. In addition, the terrain where the hunter or marksman takes up his position may be very rocky and uneven, making it difficult to place the bipod on a sure footing.

SUMMARY OF THE INVENTION

The present invention provides a novel apparatus for the support of a rifle, the apparatus being lightweight and easily transportable and which can readily be used by any hunter or marksman in the field. The invention obviates the need for locating and placing in position any ad hoc support element, and allows the hunter or marksman to position himself for secure and steady firing of the rifle at any point in the field as needed.

The invention comprises a lightweight, foldable ground mat made of a firm yet resilient material, the mat having a first recess for accommodating the legs of a rifle bipod and a second recess containing a telescoping rifle butt-support apparatus. When not being used, the rifle butt-support apparatus is maintained in a closed position within the second recess and the mat is folded onto itself for ease of transportation. When in use, the mat is unfolded and spread on the ground, thereby constituting a secure footing for the support of the rifle. A rifle bipod can then be securely supported within the first recess, and the butt of the rifle can be securely supported by the butt-support apparatus after it has been pivoted to an upright position and adjusted to the desired height or moved laterally for accurate alignment of the rifle along the required line of sight.

There is thus provided in accordance with a preferred embodiment of the present invention support apparatus for a rifle having a barrel, a bipod and a butt, the apparatus including a ground mat having first and second recesses, the first recess adapted to secure the rifle bipod and the second recess containing a telescoping member adapted to support the butt of the rifle.

Additionally in a accordance with a preferred embodiment of the present invention the telescoping member extends from the second recess when in use and is enclosed within the second recess when not in use.

Still further in accordance with a preferred embodiment of the present invention the telescoping member when in use is slidable in a direction across the line of sight of the rifle.

Further in accordance with a preferred embodiment of the present invention the height of the telescoping member relative to the mat is adjustable.

Additionally in a accordance with a preferred embodiment of the present invention the ground mat is made of polyethylene foam.

Still further in accordance with a preferred embodiment of the present invention the ground mat is foldable.

Further in accordance with a preferred embodiment of the present invention the ground mat is divided into at least two contiguous zones, for purposes of folding.

Additionally in a accordance with a preferred embodiment of the present invention the ground mat is divided into three zones, for purposes of folding.

Still further in accordance with a preferred embodiment of the present invention the first recess is arcuate and the second recess is in the shape of a "T".

Further in accordance with a preferred embodiment of the present invention the first and second recesses are metal or plastic receptacles attached to the ground mat.

Additionally in a accordance with a preferred embodiment of the present invention the ground mat is easily transportable.

There is also provided in accordance with another preferred embodiment of the present invention a combined ground mat and rifle support apparatus including a ground mat having a first recess for securing the legs of a rifle bipod and a second recess containing a telescoping member adapted to support the butt of the rifle.

Additionally in a accordance with a preferred embodiment of the present invention the telescoping member extends from the second recess when in use and is enclosed within the second recess when not in use.

Still further in a accordance with a preferred embodiment of the present invention the telescoping member when in use is slidable in a direction across the line of sight of the rifle.

Further in a accordance with a preferred embodiment of the present invention the height of the telescoping member relative to the mat is adjustable.

Additionally in a accordance with a preferred embodiment of the present invention the ground mat is made of polyethylene foam.

Still further in a accordance with a preferred embodiment of the present invention the ground mat is foldable.

Further in a accordance with a preferred embodiment of the present invention the ground mat is divided into at least two contiguous zones, for purposes of folding.

Additionally in a accordance with a preferred embodiment of the present invention the ground mat is divided into three zones, for purposes of folding.

Still further in a accordance with a preferred embodiment of the present invention the first recess is arcuate and the second recess is in the shape of a "T".

Still further in a accordance with a preferred embodiment of the present invention the first and second recesses are metal or plastic receptacles attached to the ground mat.

Further in a accordance with a preferred embodiment of the present invention the ground mat is easily transportable.

BRIEF DESCRIPTION OF THE DRAWINGS

The present invention will be understood and appreciated from the following detailed description, taken in conjunction with the drawings, in which.

DETAILED DESCRIPTION OF A PREFERRED EMBODIMENT

It is understood that the particular embodiments shown are by way of example only and are not limiting. It will be apparent to one skilled in the art that many different forms of the invention may be embodied in practice.

Figure 1:
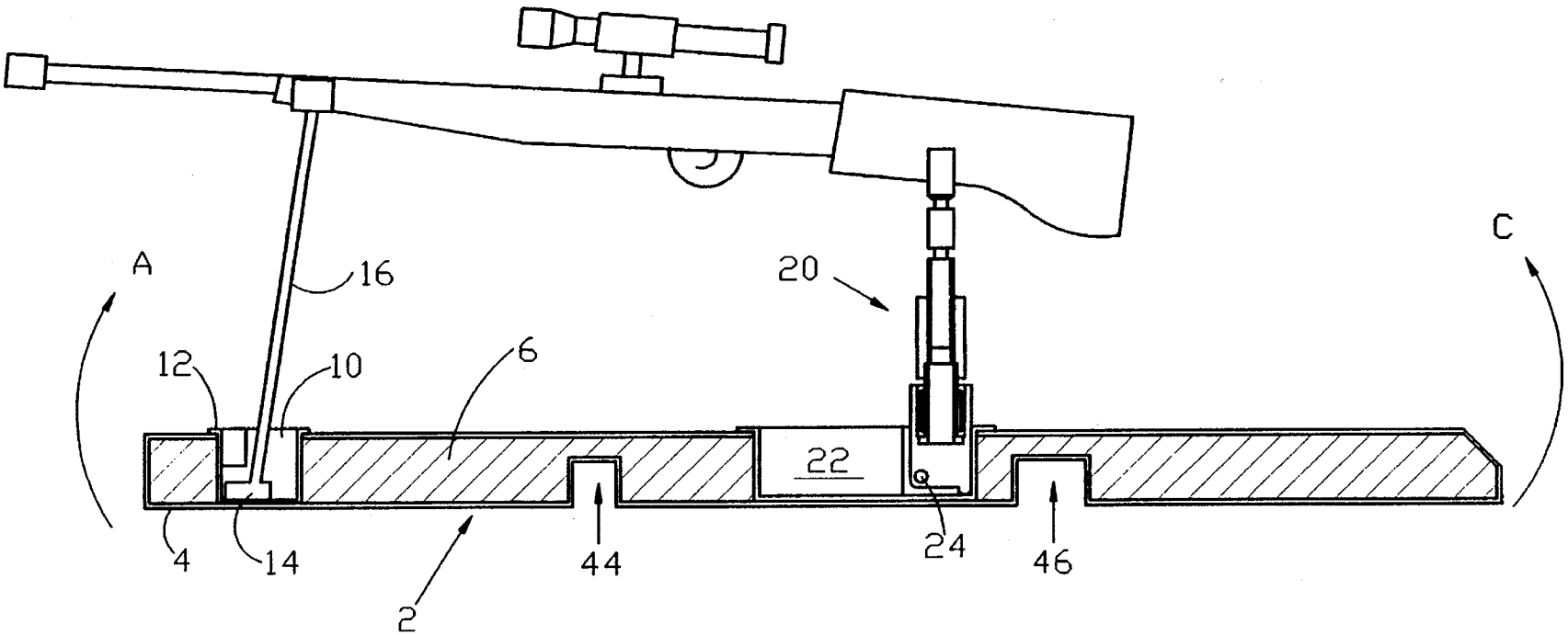
FIG. 1 is a cross-sectional view of the rifle support apparatus constructed in accordance with a preferred embodiment of the invention.
Figure 2:
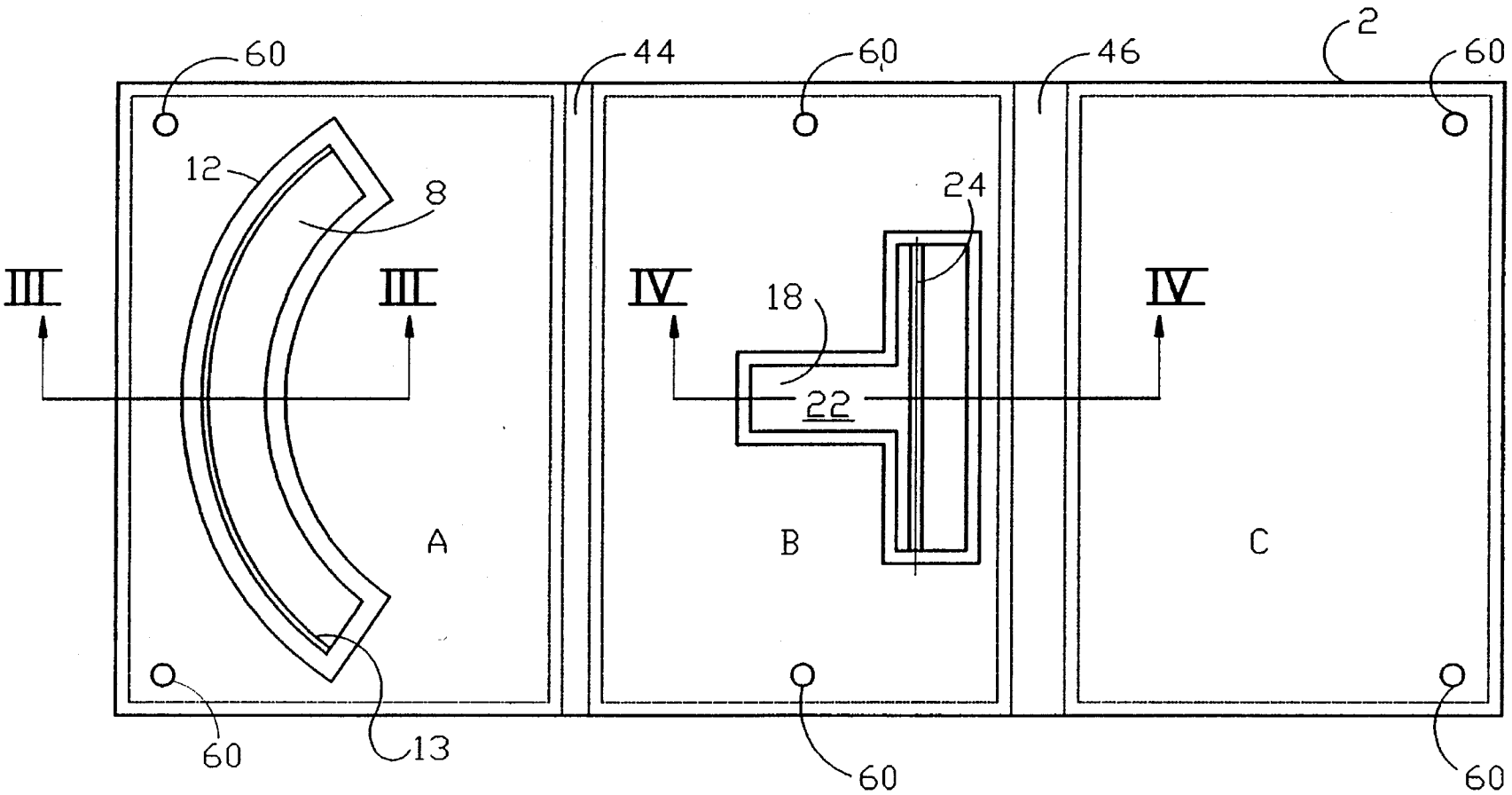
FIG. 2 is a top view of the invention of FIG. 1 showing a rifle butt-support apparatus in a closed position.

Reference is now made to FIGS. 1 and 2 which provide a cross-sectional and top view illustration, respectively, of a preferred embodiment of the invention. FIG. 1 also illustrates in outline form the mounting of a rifle utilizing the invention.

The invention comprises a ground mat 2, typically having a thickness of approximately 3 cm. and overall dimensions of 1.0–1.3 meter×0.6–0.8 meter. Ground mat 2 preferably is made of polyethylene foam 6, but any other material which provides structural firmness and at the same time is resilient, lightweight and impervious to water may also be used. Ground mat 2 is divided into three parts, referenced A, B and C, by means of grooves 44 and 46 cut into the mat, to a depth of about two-thirds of the mat thickness. Groove 44 is narrower than groove 46, so as to enable appropriate flexibility in the folding of mat 2, as explained below with reference to FIGS. 6 and 7.

Part A of ground mat 2 has a first recess or cut-out portion 10, which preferably is arcuate in shape, as shown in FIG. 2, but which alternatively may be rectangular. Cemented or otherwise affixed to mat 2 at the edges of first recess 10 is a first receptacle 8, having the same general shape as the first recess 10. First receptacle 8 is made of rigid plastic or a light-weight metal and is formed with a flange 12 along the upper surface. The dimensions of first receptacle 8 and first recess 10 are such that first receptacle 8 will fit closely into the first recess 10 of mat 2. The purpose of flange 12 will be described hereinbelow.

A strip of rubber 13 may be attached along the interior surface of the forward facing portion of first receptacle 8 for enhanced retention of a bipod 16 in an open position and to prevent the legs 14 of the bipod from inadvertently jumping out of receptacle 8 when firing.

Part B of ground mat 2 has a second recess or cut-out portion 22, but this second recess 22 is in the shape of a "T" as shown in FIG. 2. Cemented or otherwise affixed to mat 2 at the edges of the second recess 22 is a second receptacle 18, having the same general "T" shape as the second recess 22. Second receptacle 18 is formed with a leg section 21 and a head section 23. Second receptacle 18 is made of rigid plastic or a light-weight metal and is formed with a flange 19 along the upper surface. The dimensions of second receptacle 18 and second recess 22 are such that second receptacle 18 will fit closely into the second recess 22 of mat 2. The purpose of flange 19 will be described hereinbelow.

A metallic or plastic rod 24 is fixedly lodged within the head section 23 of the second receptacle 18, slightly off of center, in the direction of leg section 21.

Figure 4:
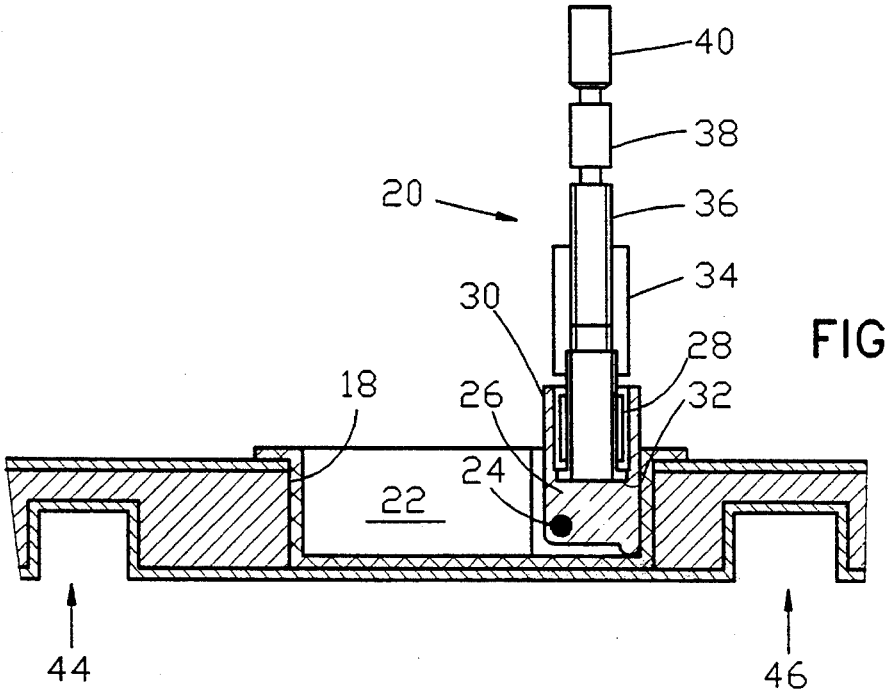
FIG. 4 is a cross-sectional view, on an enlarged scale, of a detail of FIGS. 1 and 2, along plane IV—IV, showing the rifle butt-support apparatus in an upright position.

Reference is now made also to FIG. 4 which illustrates in greater detail rifle butt-support apparatus 20 according to a preferred embodiment of the invention. Support apparatus 20 comprises a base block 26 which is slidably mounted on rod 24.

A first cylindrical recess 25 is formed in base block 26 with a shoulder 27 proxal the bottom 31 of recess 25. Into cylindrical recess 25 is press-fitted a bearing 28. The bearing 28 is located axially against the shoulder 27 of first cylindrical recess 25. The inner race of bearing 28 is a sleeve 30 having a circular flange 32 adjacent the lower end of the sleeve 32 as shown in FIG. 2. The bearing 28 fixes sleeve 30 in its axial position relative to block 26. The dimensions of bearing 28, shoulder 27 and circular flange 32 are such that sleeve 30 is rotatably mounted in cylindrical recess 25 of block 26.

Figure 5:
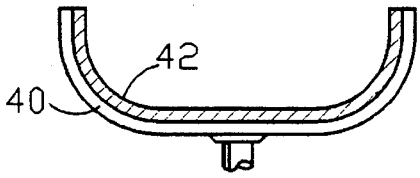
FIG. 5 is a side view of one of the elements shown in FIG. 4.

The opposite end of sleeve 30 projects from block 26 and is press-fitted into a second circular recess 29 machined into a cylindrical nut 34. Nut 34 is formed with an internal thread, and threaded therein is shaft 36. Shaft 36 is coupled to an intermediate piece 38 and thereby to support 40. Intermediate piece 38 may be of variable length, or may be dispensed with entirely. Support 40 is generally "U"-shaped as shown in FIG. 5, and has a rubberized or plastic lining 42. It will be appreciated that rotating nut 34 in one direction will cause elements 36, 38 and 40 to extend upward, thereby raising the height of support 40 with respect to the ground. Rotating nut 34 in the opposite direction will have the opposite effect, causing a decrease in the overall length of butt-support apparatus 20. When telescoped to its shortest extent, butt-support apparatus 20 can then be pivoted along rod 24 and placed within second recess the leg 21 of second recess 22, as shown in FIG. 2.

The overall operation of the invention will now be described. The marksman first determines the location of firing, and places the mat on the ground, with part A facing the general line of fire. He then places the legs 14 of bipod 16 (FIG. 1) of his rifle within receptacle 8. Next, he pivotally raises apparatus 20 from its closed position within the "T" receptacle. He then places the butt of his rifle onto support 40 and determines the height convenient for his purposes by rotating nut 34. Finally, he determines the specific line of sight of firing by positioning apparatus 20 at a desired point along rod 24.

Figure 6:
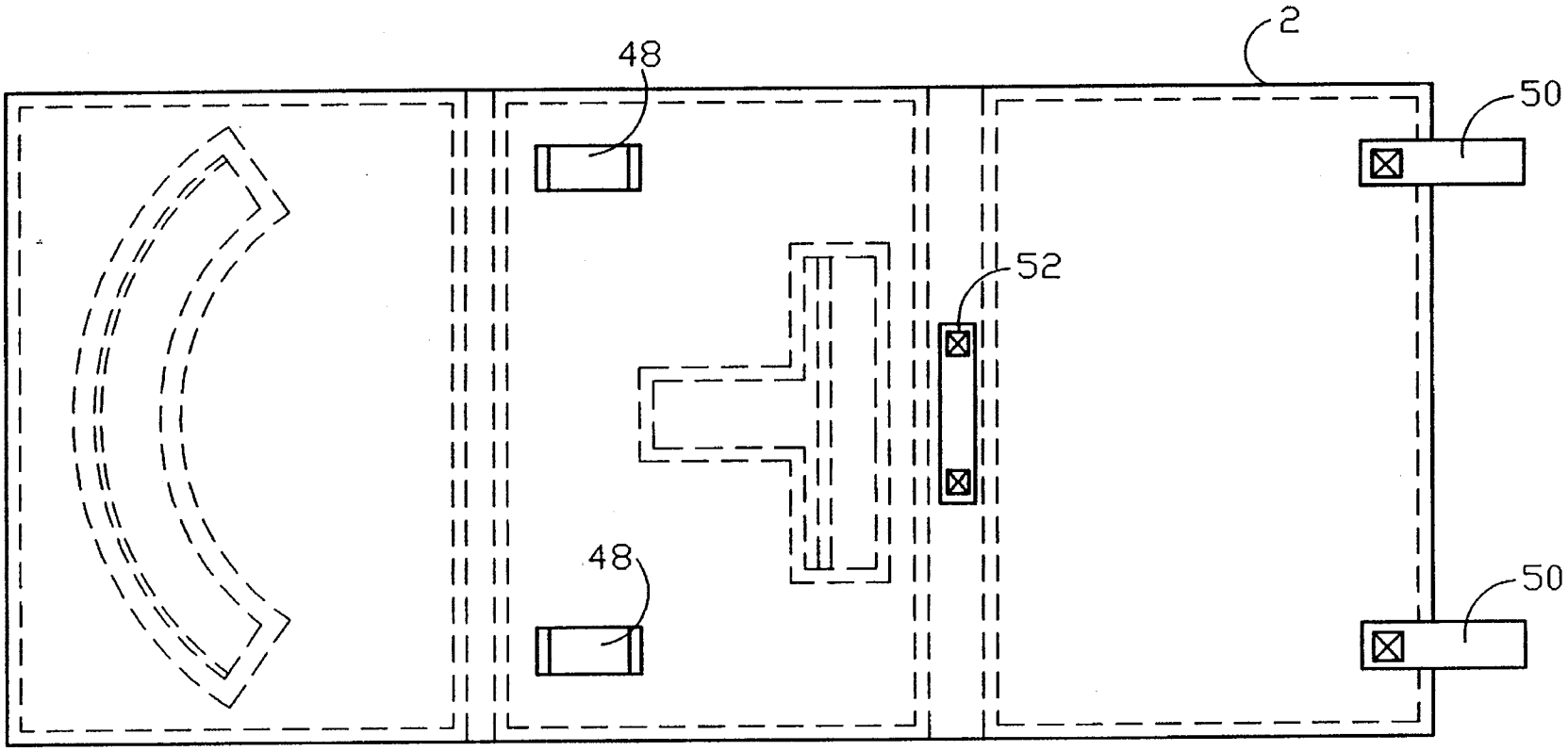
FIG. 6 is a rear-view of the invention of FIG. 1, showing attachments which facilitate its transportation.
Figure 7:
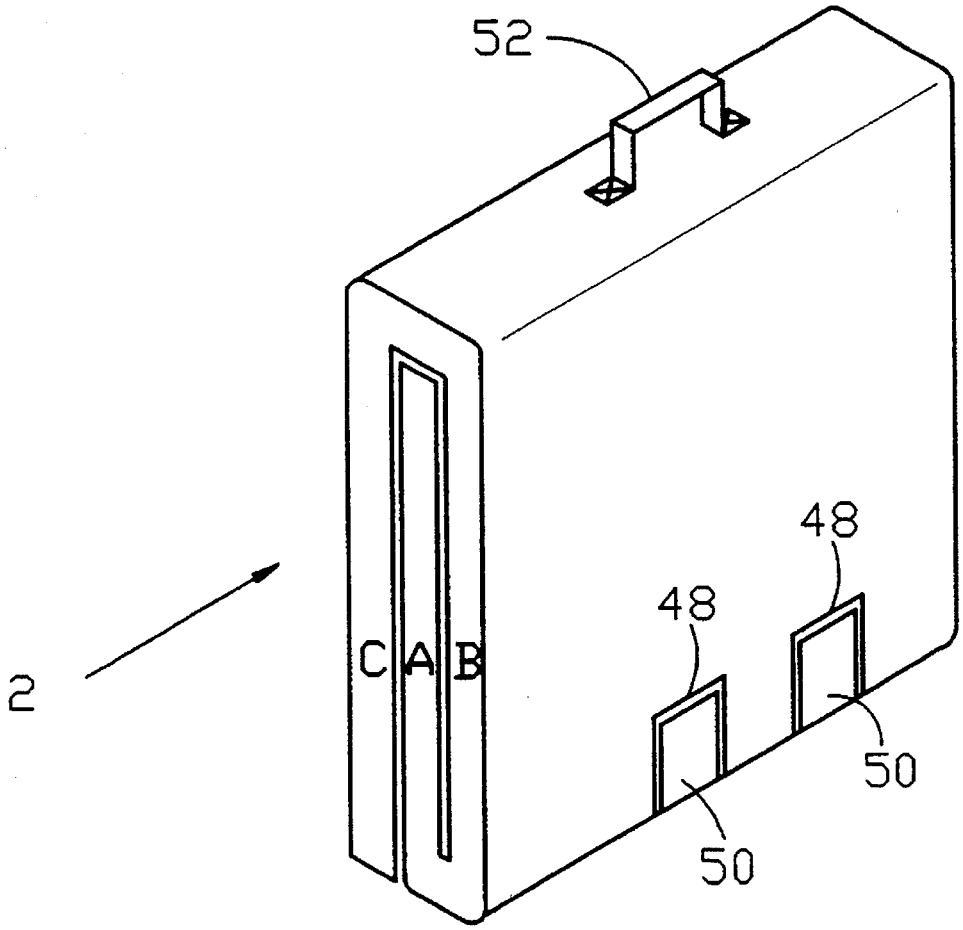
FIG. 7 is a perspective view of the apparatus when folded.

Reference is now made to FIGS. 6 and 7, which illustrate transportability features of the apparatus in accordance with the invention. As explained above, mat 2 is divided into three parts, A, B and C, by means of partial grooves 44 and 46. Grooves 44 and 46 enable the folding of the mat onto itself, for ease of carrying. Groove 44 facilitates the folding of part A, in the direction of arrow 7 of FIG. 1, onto part B, and groove 46 facilitates the folding of part C, in the direction of arrow 9 of FIG. 1, onto and around parts A and B after they have been folded onto each other. On the underside of mat 2 there may also be provided a handle 52, and sets of fastening devices 48 and 50, which retain the mat in the folded position. Fastening devices 48 and 50 may be of the Velcro brand type of fasteners, or any other fasteners as known in the art.

Figure 3:
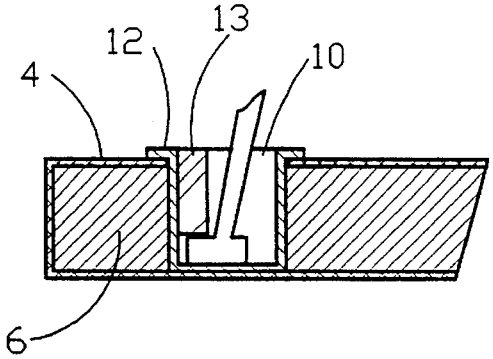
FIG. 3 is a cross-sectional view, on an enlarged scale, of a detail of FIGS. 1 and 2, along plane III—III.

Mat 2 may be provided with certain additional features, both functional and aesthetic. For example, the mat may be encased in a cover-slip (reference 4 in FIGS. 1 and 3) made of a washable material, which protects the mat itself and provides a more comfortable feeling during use. Cover-slip 4 is provided with suitable openings to correspond with the shape of receptacles 8 and 18, and the edges of these openings are retained by means of flange 12 of the first receptacle 8, as shown in FIG. 3, and flange 19 of second receptacle 18. Mat 2 may also be provided with bushings 60 (FIG. 2), attached to the mat close the edges, to enable the mounting of support posts and the like which could be used to support a material covering the mat, for purposes of shade or camouflage.

It will be apparent to one skilled in the art that the structure of butt-support 20 described hereinabove is merely one embodiment of many possible structures suitable for implementation in the context of the present invention. For example, bearing 28 (FIG. 4) could just as well be a bushing made of low-friction material, being suitably retained in block 26 by a retaining ring. Or, the screw and nut type mechanism described for telescoping the height of apparatus 20 could be replaced with other known mechanisms (e.g. a worm-and-wormwheel, or a rack and pinion arrangement) that accomplish the same purpose.

Figure 8:
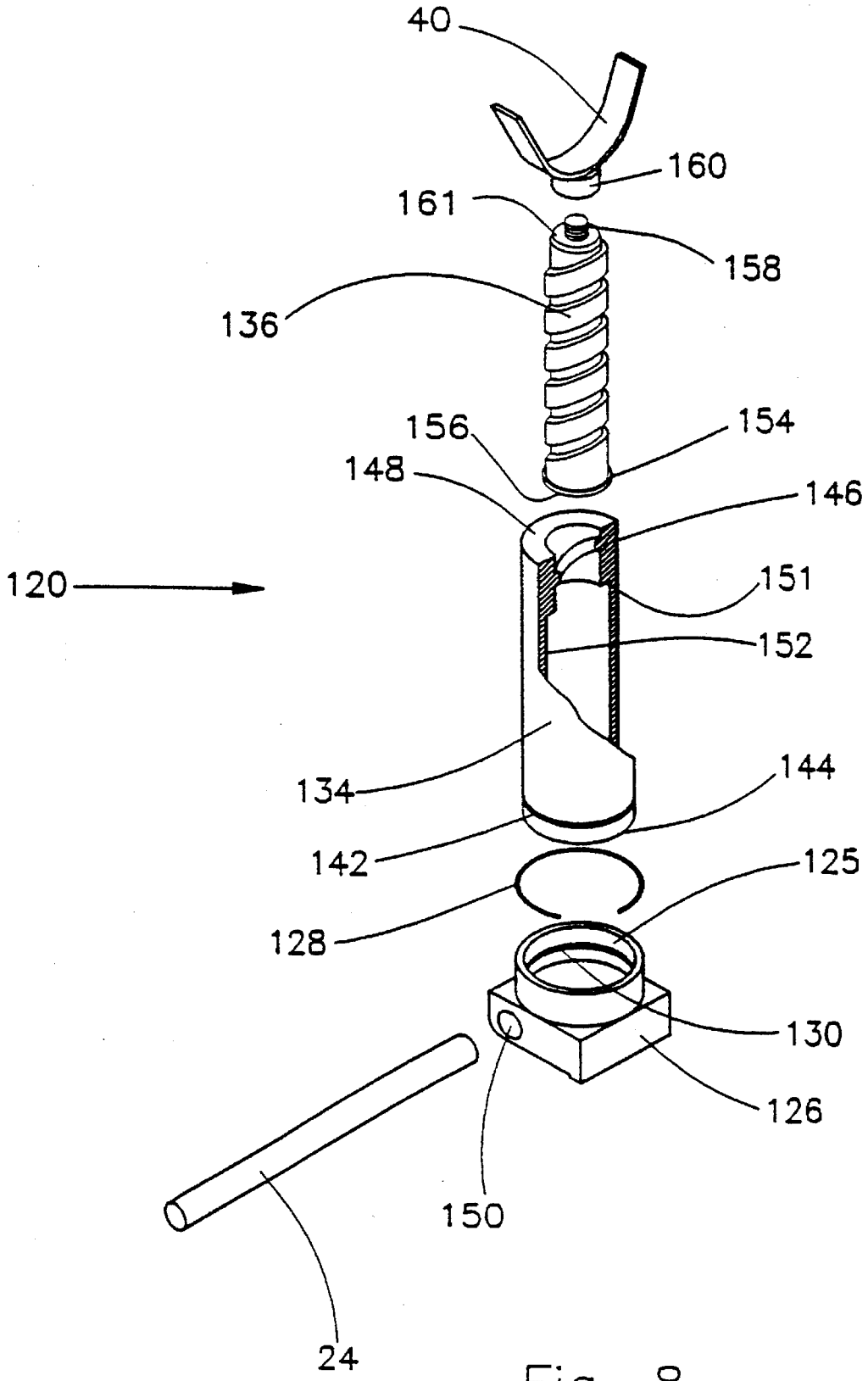
FIG. 8 which is a perspective partially cut-away and exploded view of an alternative embodiment of the rifle butt-support apparatus.

Reference is now made to FIG. 8 which is a perspective partially cut-away and exploded view of an alternative embodiment of the rifle butt-support apparatus. Butt-support apparatus 120 comprises a base block 126, a locating spring 128, a rotating sleeve 134, a threaded rod 136 and a support 40.

Base block 126 if formed with a cylindrical recess 125 into which is formed a first circular groove 130. Base block 126 is also formed with a through hole 150 proxal the lower end of base block 126 as seen in FIG. 8.

Rotating sleeve 134 is formed with a second circular groove 142 proxal the lower end 144 of the rotating sleeve 134. Rotating sleeve 134 is also formed with an internal threaded portion 146 adjacent the top 148 of the sleeve 134. The internal threaded portion 146 extends downward from the top 148 typically about ⅛ to about ⅓ the distance to the bottom 144 of rotating sleeve 134. The lower end of the threaded portion 146 forms a first shoulder 151 on the inner cylindrical surface 152 of sleeve 134. The purpose of the first shoulder 151 and threaded portion 146 will be explained hereinbelow.

Threaded rod 136 is formed with a second shoulder 154 adjacent a bottom 156 of threaded rod 136. Threaded rod 136 is also formed with a second threaded portion 158 at the top 161 of threaded rod 136. The purpose of the second shoulder 154 and the second threaded portion 158 will be explained hereinbelow.

The support 40 is formed with a rod portion 160 into which is formed an internal thread (not shown).

Locating spring 128 may be generally circular in shape and may encompass typically about ½ to about ¾ of a complete circle. The cross section of locating spring 128 may be circular in shape.

The assembly and operation of butt-support apparatus 120 will now be explained. Threaded rod 136 is inserted into the bottom 144 of rotating sleeve 134 and engaged with the internal threaded portion 146. The dimensions of the internal threaded portion 146 and the threaded rod 136 are such that the threaded rod 136 rotates freely within the internal threaded portion 146. It will be apparent that a relative rotational motion between the threaded rod 136 and the rotating sleeve 134 will cause the threaded rod 136 to move axially with respect to the rotating sleeve 134.

Locating spring 128 is then placed in the second circular groove 142 and the assembly comprising the threaded rod 136, the rotating sleeve 134 and the locating spring 128 is inserted into the cylindrical recess 125 of the base block 126 so that the locating spring 128 fits into the first circular groove 130 of base block 126. The dimensions of the locating spring 128, the first and second circular grooves 130 and 142, the cylindrical recess 125 and the rotating sleeve 134 are such that the rotating sleeve 134 is rotatably mounted in base block 126 and axially fixed therein.

The rod portion 160 of support 40 is then threaded onto the second threaded portion 158 of threaded rod 136.

A metallic or plastic rod 24 is then inserted into hole 150 of the base block 126. The dimensions of rod 24 and hole 150 are such that base block 126 can move freely along the axis of rod 24 and rotate freely thereabout.

Figure 9A:
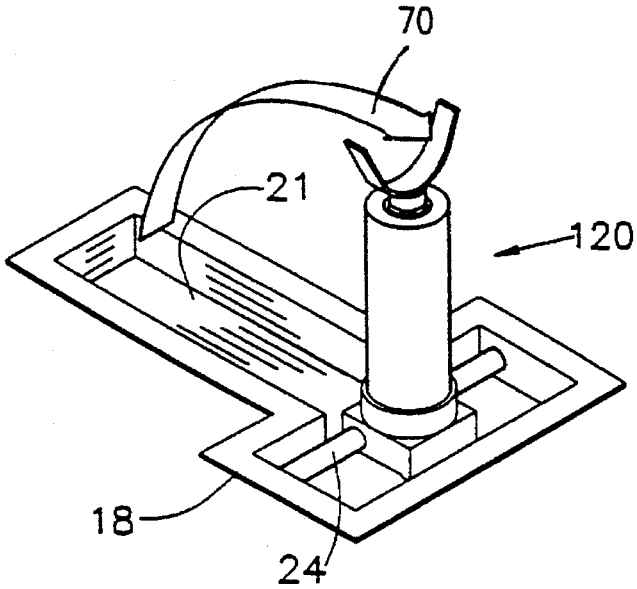
FIG. 9A is a perspective view of the rifle butt-support apparatus in an upright contracted position.

Reference is now also made to FIG. 9A which a perspective view of the rifle butt-support apparatus in an upright contracted position. The butt-support 120 is normally stored in the closed contracted condition within the leg section 21 of second receptacle 18, as shown in FIG. 2. In use, the butt-support 120 is rotated about rod 24 in the direction of the arrow 70 to the open contracted position.

Figure 9B:
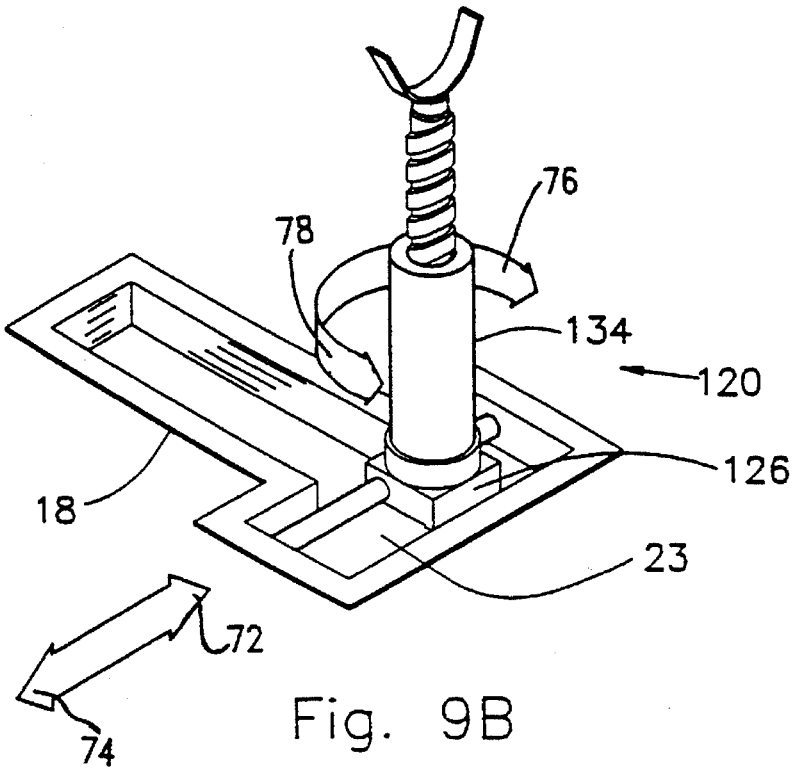
FIG. 9B is a perspective view of the rifle butt-support apparatus in an upright extended position.

Reference is now also made to FIG. 9B which is a perspective view of the rifle butt-support apparatus in an upright extended position. The butt-support 120 can be moved laterally along the rod 24 within the head section 23 of second receptacle 18, in the direction of arrows 72 and 74, across the line of sight of the rifle. Rotating element 134 may be rotated about base block 126, in the directions of arrows 76 and 78 to raise or lower the support 140, to further accommodate different firing positions of the rifle.

Rotating sleeve 134 in one direction will cause the threaded rod 136 to contract to the closed position as shown in FIG. 9A. Rotating sleeve 134 in the other direction will cause threaded rod 136 to extend until the second shoulder 154 of threaded rod 136 encounters the first shoulder 151 of sleeve 134. The extended position of butt-support apparatus 120 is shown in FIG. 9B.

Figure 10:
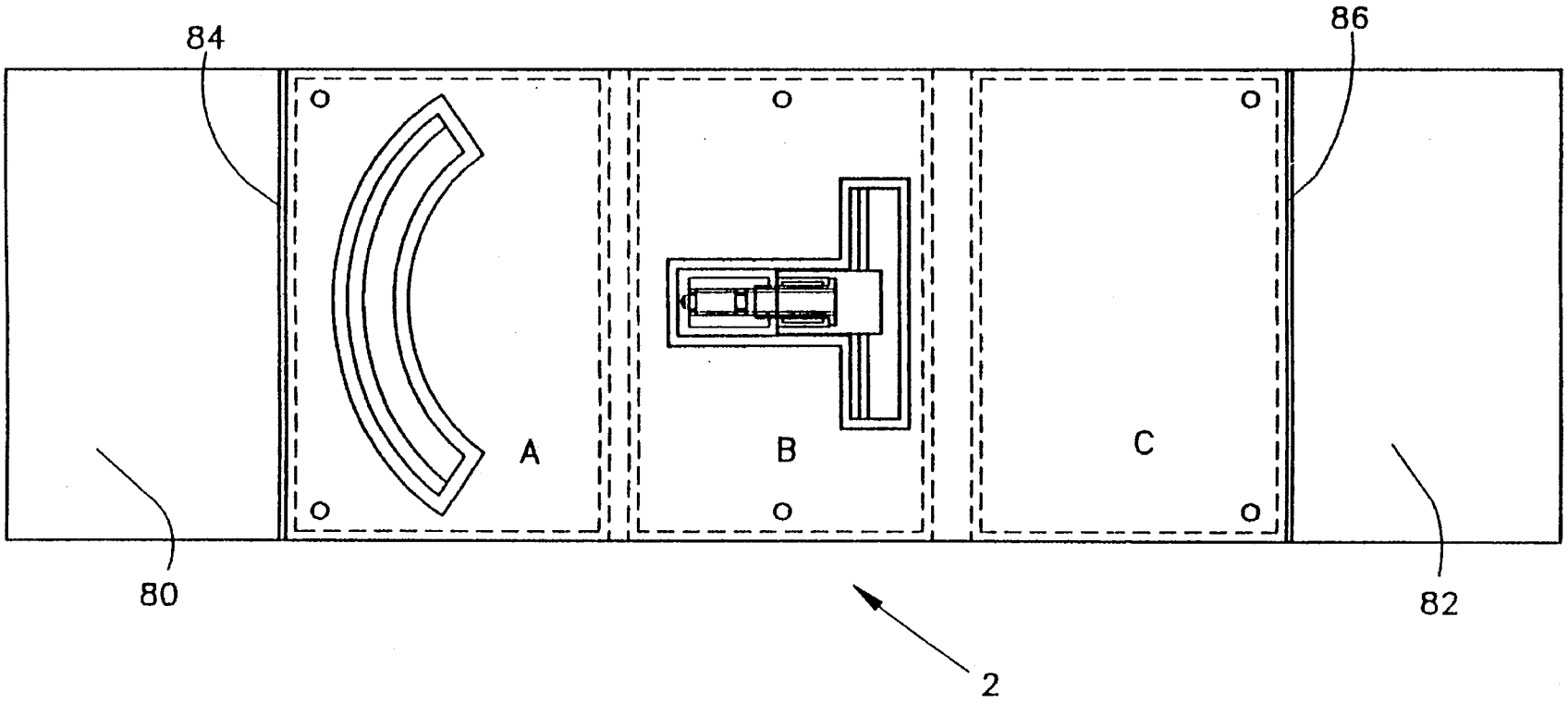
FIG. 10 is a top view of the embodiment shown in FIG. 1 showing a front and rear ground sheet.

Reference is now made to FIG. 10 which is a top view of the embodiment shown in FIG. 1 showing a front ground sheet 80 and a rear ground sheet 82. Front ground sheet 80 may be attached to a front edge 84 of mat 2 and may be spread out in front of the ground mat 2. Front ground sheet 82 may extend along the ground past the barrel of the rifle of FIG. 1. The purpose of front ground sheet 80 is to prevent dirt, dust and other extraneous material that may be raised when the rifle is fired from obscuring the vision of the marksman.

Rear ground sheet 82 may be attached to a rear edge 86 of ground mat 2. The purpose of rear ground sheet 82 is to allow the marksman to lie comfortably along the ground in the event that the ground surface is wet or otherwise uncomfortable to the marksman.

The front and rear ground sheets may be attached to the mat 2 or may be removable therefrom. The front and rear ground sheets may be attached to the ground mat with Velco strips or other suitable attachment means. The connection between the front and rear ground sheets and the ground mat 2 are not shown in FIG. 10.

The dimensions of front and rear ground sheets 80 and 82 may be such that they fold within the mat 2 when the mat is folded for transportation as shown in FIG. 7.

It will thus be evident that the invention is not limited to the details of the foregoing illustrated embodiment. The embodiment is to be considered in all respects as illustrative and not restrictive, and the scope of the invention is indicated by the following claims and all equivalents thereto:

I claim:

1. Support apparatus for a rifle having a barrel defining a line of sight, a bipod and a butt, the apparatus comprising:

a ground mat having first and second recesses;

the first recess adapted to secure the rifle bipod and the second recess containing a telescoping member adapted to support the butt of the rifle and wherein the telescoping member when in use is slidable in a direction across the line of sight of the rifle.

2. Apparatus according to claim 1 wherein the telescoping member extends from the second recess when in use and is enclosed within the second recess when not in use.

3. Apparatus according to claim 2 wherein the height of the telescoping member relative to the mat is adjustable.

4. Apparatus according to claim 1 wherein the ground mat is foldable.

5. Apparatus according to claim 4 wherein the ground mat is divided into at least two contiguous zones, for purposes of folding.

6. Apparatus according to claim 1 wherein the ground mat is easily transportable.

7. Support apparatus for a rifle having a barrel, a bipod and a butt, the apparatus comprising:

a ground mat having first and second recesses;

the first recess adapted to secure the rifle bipod and the second recess containing a telescoping member adapted to support the butt of the rifle wherein the ground mat is made of polyethylene foam.

8. Apparatus according to claim 7 and wherein the ground mat is foldable.

9. Support apparatus for a rifle having a barrel, a bipod and a butt, the apparatus comprising:

a ground mat having first and second recesses;

the first recess adapted to secure the rifle bipod and the second recess containing a telescoping member adapted to support the butt of the rifle, wherein the ground mat is foldable and wherein the ground mat is divided into three zones, for purposes of folding.

10. Support apparatus for a rifle having a barrel, a bipod and a butt, the apparatus comprising:

a ground mat having first and second recesses;

the first recess adapted to secure the rifle bipod and the second recess containing a telescoping member adapted to support the butt of the rifle, wherein the first recess is arcuate and the second recess is in the shape of a "T".

11. Apparatus according to claim 10 wherein the first and second recesses are metal or plastic receptacles attached to the ground mat.

12. A combined ground mat and rifle support apparatus for use with a rifle having a bipod, a barrel defining a line of sight and a butt and comprising:

a ground mat having a first recess for securing legs of a rifle bipod and a second recess containing a telescoping member adapted to support the butt of the rifle, wherein the telescoping member extends from the second recess when in use and is enclosed within the second recess when not in use and wherein the telescoping member when in use is slidable in a direction across the line of sight of the rifle.

13. Apparatus according to claim 12 wherein the height of the telescoping member relative to the mat is adjustable.

14. Apparatus according to claim 12 wherein the ground mat is foldable.

15. Apparatus according to claim 14 wherein the ground mat is divided into at least two contiguous zones, for purposes of folding.

16. Apparatus according to claim 12 wherein the ground mat is easily transportable.

17. A combined ground mat and rifle support apparatus for use with a rifle having a bipod, a barrel defining a line of sight and a butt and comprising:

a ground mat having a first recess for securing legs of a rifle bipod and a second recess containing a telescoping member adapted to support the butt of the rifle, wherein the telescoping member extends from the second recess when in use and is enclosed within the second recess when not in use and wherein the ground mat is made of polyethylene foam.

18. Apparatus according to claim 17 and wherein the ground mat is foldable.

19. Apparatus according to claim 17 and wherein the first recess is arcuate and the second recess is in the shape of a "T".

20. A combined ground mat and rifle support apparatus for a rifle having a barrel, a bipod and a butt, the apparatus comprising:

a ground mat having a first recess for securing the legs of a rifle bipod and a second recess containing a telescoping member adapted to support the butt of the rifle, wherein the ground mat is foldable and wherein the ground mat is divided into three zones, for purposes of folding.

21. A combined ground mat and rifle support apparatus for a rifle having a barrel, a bipod and a butt, the apparatus comprising:

a ground mat having a first recess for securing the legs of a rifle bipod and a second recess containing a telescoping member adapted to support the butt of the rifle, wherein the first recess is arcuate and the second recess is in the shape of a "T".

22. Apparatus according to claim 21 wherein the first and second recesses are metal or plastic receptacles attached to the ground mat.

* * * * *